US007789706B2

(12) United States Patent
Chen et al.

(10) Patent No.: US 7,789,706 B2
(45) Date of Patent: Sep. 7, 2010

(54) TERMINAL SHIELD AND ELECTRICAL CONNECTOR WITH A TERMINAL SHIELD

(75) Inventors: Ching-Tien Chen, Hsin-Tien (TW); Pin-Yuan Hou, Hsin-Tien (TW); Wen-Chih Ko, Hsin-Tien (TW)

(73) Assignee: Advanced Connectek Inc., Hsin-Tien, Taipei Hsien (TW)

( * ) Notice: Subject to any disclaimer, the term of this patent is extended or adjusted under 35 U.S.C. 154(b) by 29 days.

(21) Appl. No.: 12/378,698

(22) Filed: Feb. 18, 2009

(65) Prior Publication Data

US 2010/0136830 A1 Jun. 3, 2010

(30) Foreign Application Priority Data

Dec. 3, 2008 (TW) ..... 97221623 U

(51) Int. Cl.
*H01R 13/648* (2006.01)

(52) U.S. Cl. ..... 439/607.35; 439/660

(58) Field of Classification Search ..... 439/607.35–38, 439/607.11, 607.05, 660
See application file for complete search history.

(56) References Cited

U.S. PATENT DOCUMENTS

| | | | | |
|---|---|---|---|---|
| 6,296,518 | B1 * | 10/2001 | Avery et al. | 439/541.5 |
| 6,890,215 | B2 * | 5/2005 | Lang et al. | 439/607.35 |
| 7,179,127 | B2 * | 2/2007 | Shiu | 439/607.35 |
| 2006/0014431 | A1 * | 1/2006 | Shuey et al. | 439/607 |

* cited by examiner

*Primary Examiner*—Hien Vu
(74) *Attorney, Agent, or Firm*—Charles E. Baxley

(57) ABSTRACT

An electrical connector has an insulative housing, a plurality of first terminals, a plurality of second terminals and a terminal shield. The first and second terminals are mounted in the insulative housing and each terminal has a soldering segment. The terminal shield substantially shields the soldering segments of the second terminals and prevents electromagnetic interference so that transmitting high frequency signals on the second terminals is stable.

9 Claims, 12 Drawing Sheets

TERMINAL SHIELD AND ELECTRICAL CONNECTOR WITH A TERMINAL SHIELD

BACKGROUND OF THE INVENTION

1. Field of the Invention

The present invention relates to a connector, and more particularly to an electrical connector that complies with USB (Universal Serial Bus) 2.0 and 3.0 transmission protocols and has a terminal shield shielding and preventing terminals from electromagnetic interference.

2. Description of Related Art

Conventional USB 2.0 connectors are popular in various electronic devices. However, the USB 2.0 transmission protocol only allows a maximum transmission speed of 480 Mbps. Because electronic devices are constantly developed to increase transmission speed, the USB 2.0 transmission protocol does not meet the current transmission speed requirement of these electronic devices. Therefore, the USB IF (USB Implementers Forum) is setting up a USB 3.0 transmission protocol that may achieve a theoretical maximum transmission speed of 4.8 Gbps, almost 10 times of that of the USB 2.0 transmission protocol.

However, to implement the transmission of 4.8 Gbps, terminals of a USB 3.0 connector must be capable of transmitting high frequency signals. Transmitting high frequency signals usually encounters electromagnetic interference from nearby electronic components so that the impedance of the USB 3.0 connector unstably alternates and reduces signal transmission.

Furthermore, a manufacturer of the USB 3.0 connector frequently encounters connector mating problems. One manufacturer's USB 3.0 receptacle connector mates self-made plug connector and passes through an impedance test however does not mates plug connector produced by other manufacturers well to fail the impedance test so that signal transmission between USB 3.0 connectors by different manufacturers is unenforceable.

To overcome the shortcomings, the present invention provides an electrical connector with a terminal shield to mitigate or obviate the aforementioned problems.

SUMMARY OF THE INVENTION

The main objective of the invention is to provide an electrical connector that complies with Universal Serial Bus (USB) 2.0 and 3.0 transmission protocols and has a terminal shield shielding and preventing terminals from electromagnetic interference.

An electrical connector in accordance with the present invention has an insulative housing, a plurality of first terminals, a plurality of second terminals and a terminal shield. The first and second terminals are mounted in the insulative housing and each terminal has a soldering segment. The terminal shield substantially shields the soldering segments of the second terminals and prevents electromagnetic interference so that transmitting high frequency signals on the second terminals is stable.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
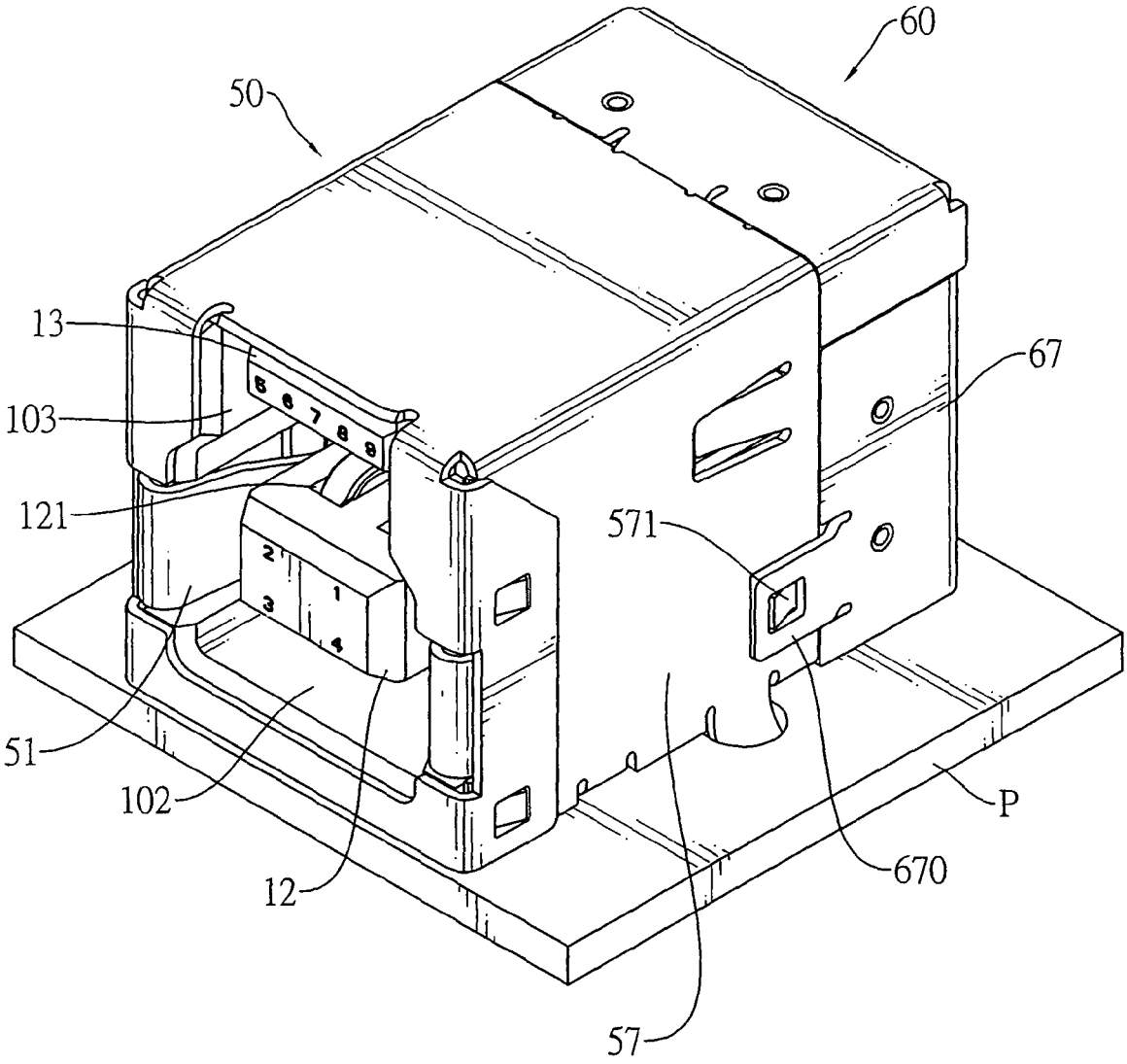
FIG. 1 is a perspective view of an electrical connector in accordance with the present invention.
Figure 2:
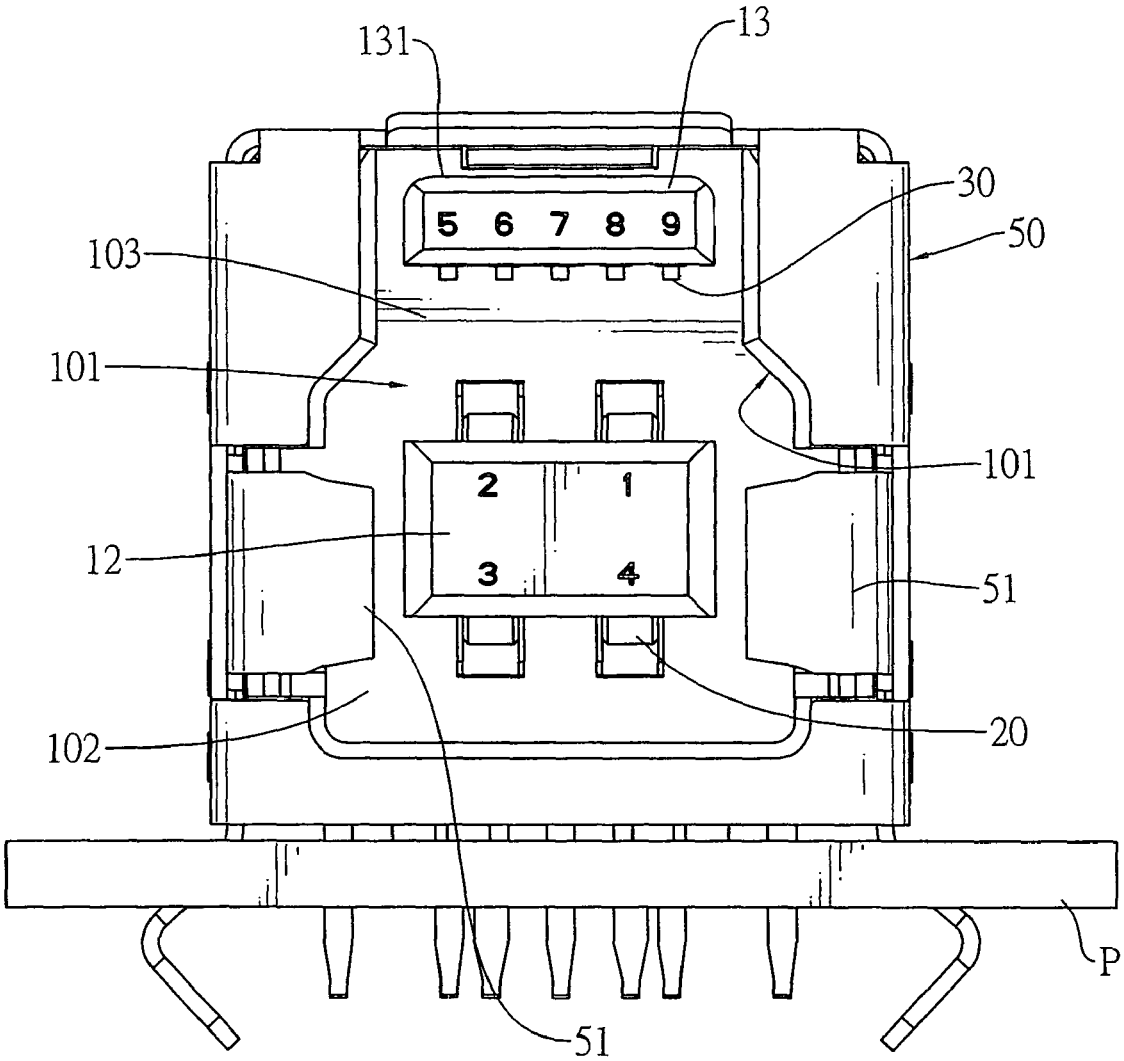
FIG. 2 is a front view of the electrical connector in FIG. 1 mounted on a PCB (printed circuit board)
Figure 3:
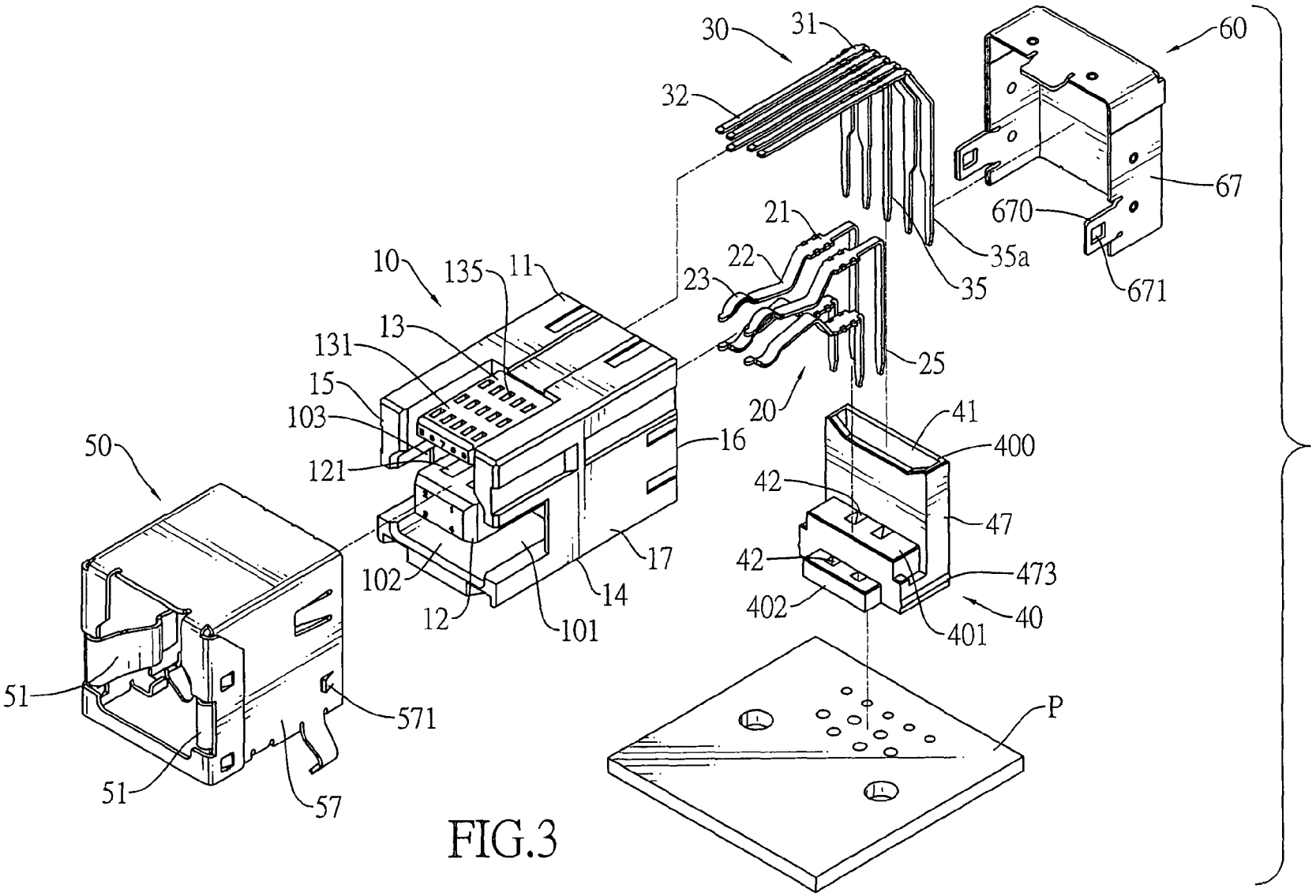
FIG. 3 is an exploded front perspective view of the electrical connector and the PCB in FIG. 2.
Figure 4:
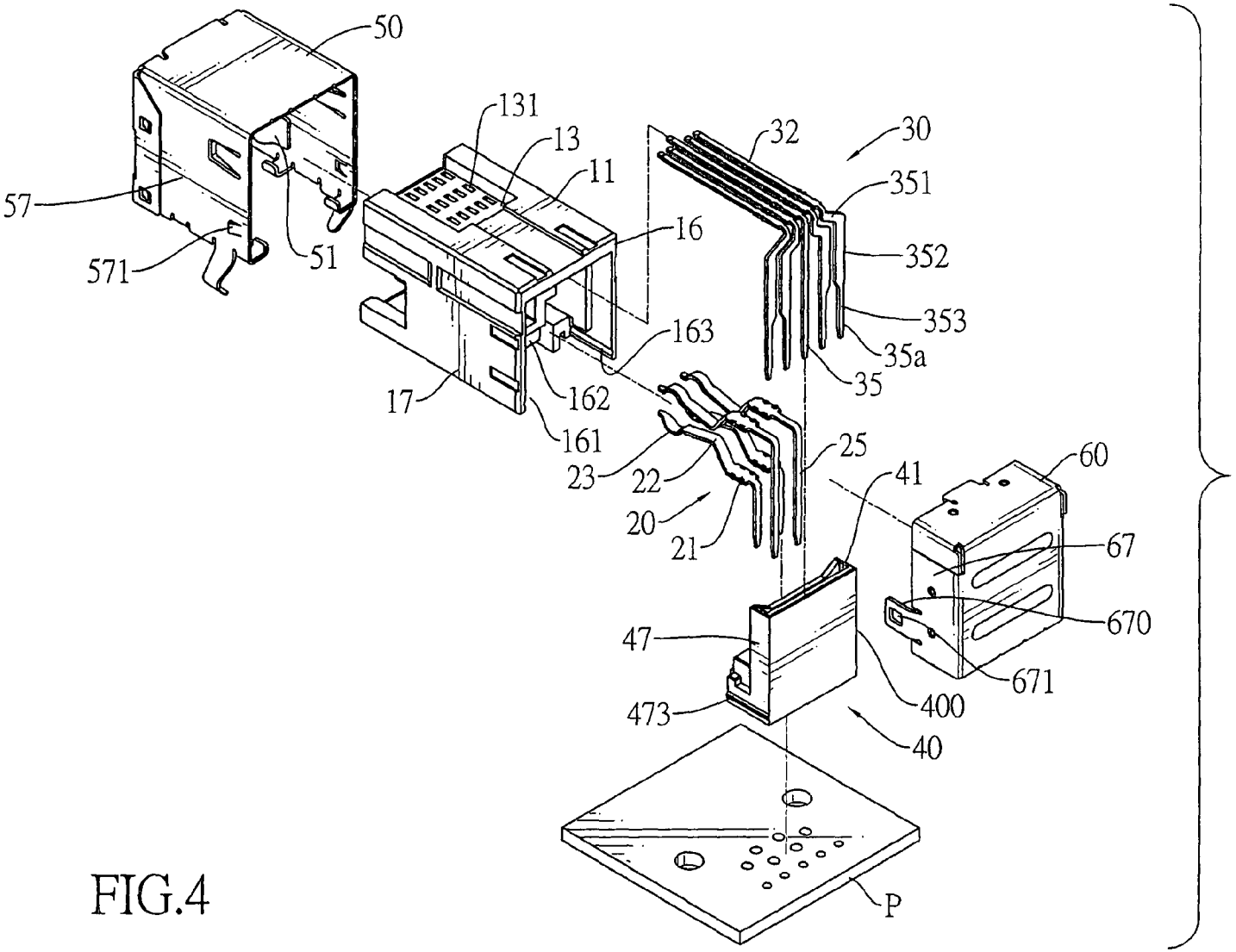
FIG. 4 is an exploded rear perspective view of the electrical connector and the PCB in FIG. 3.
Figure 5:
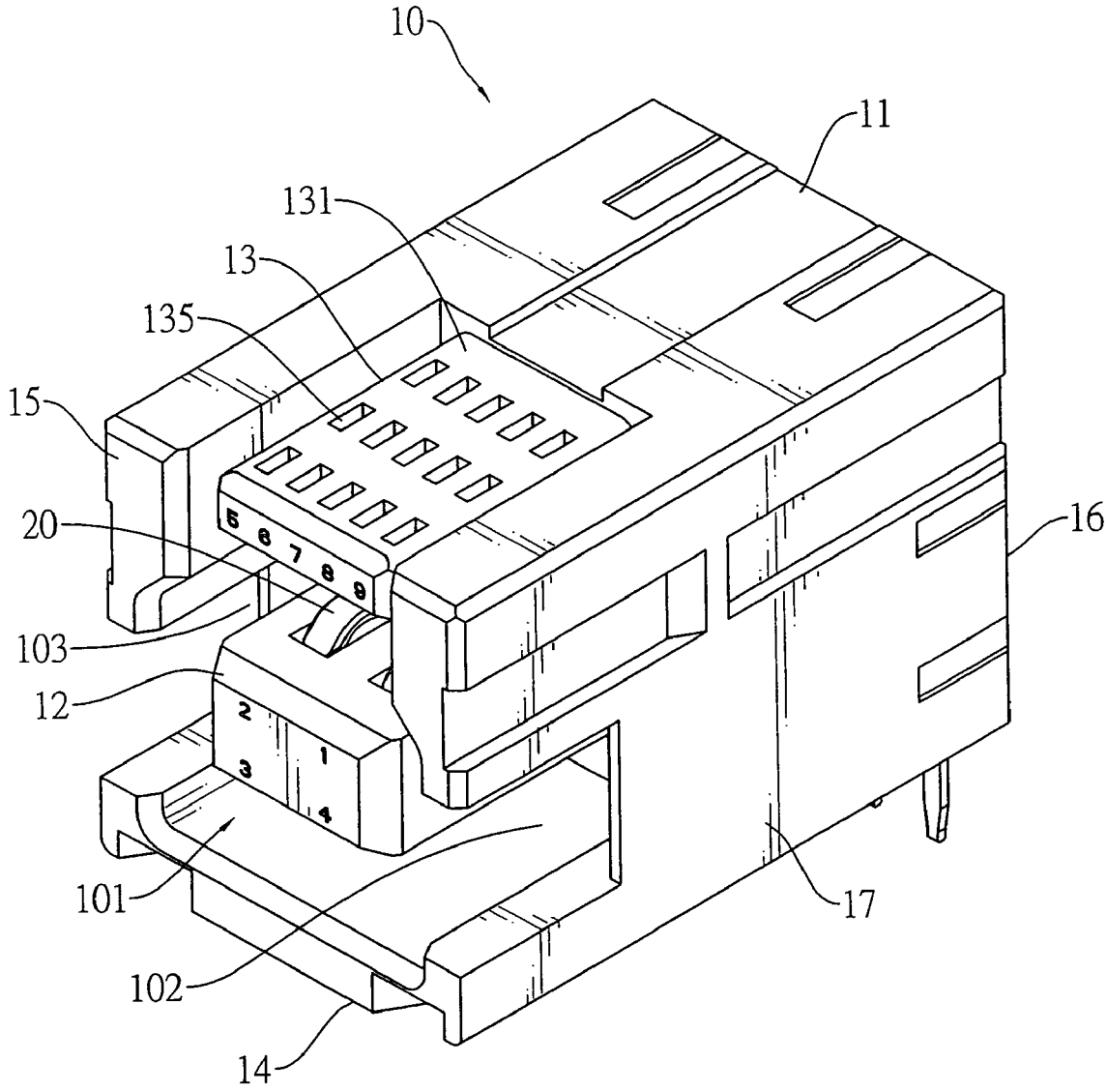
FIG. 5 is a top perspective view of the electrical connector in FIG. 1 without the metal shell assembly.
Figure 6:
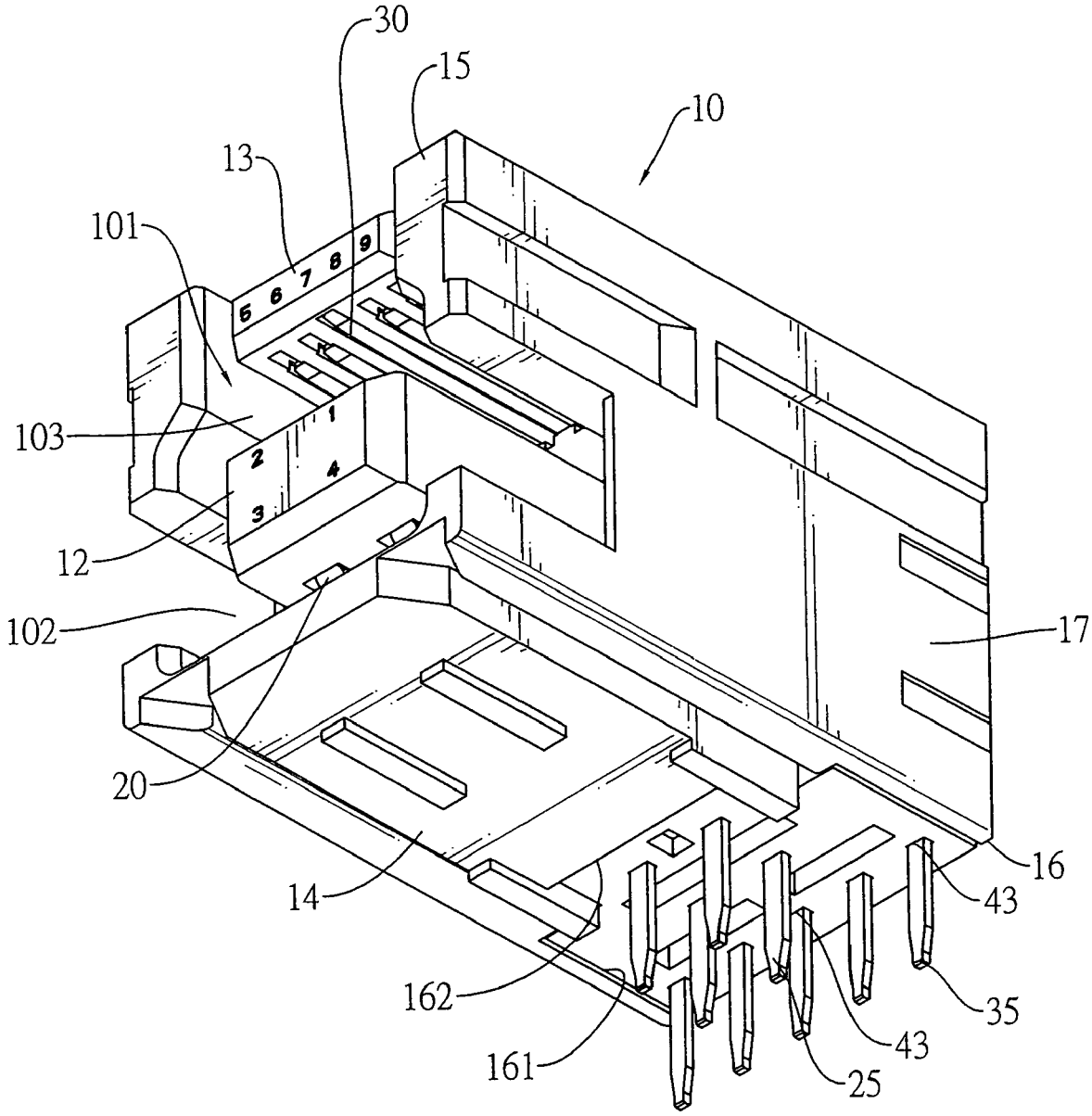
FIG. 6 is a bottom perspective view of the electrical connector in FIG. 5 without the metal shell assembly.
Figure 7:
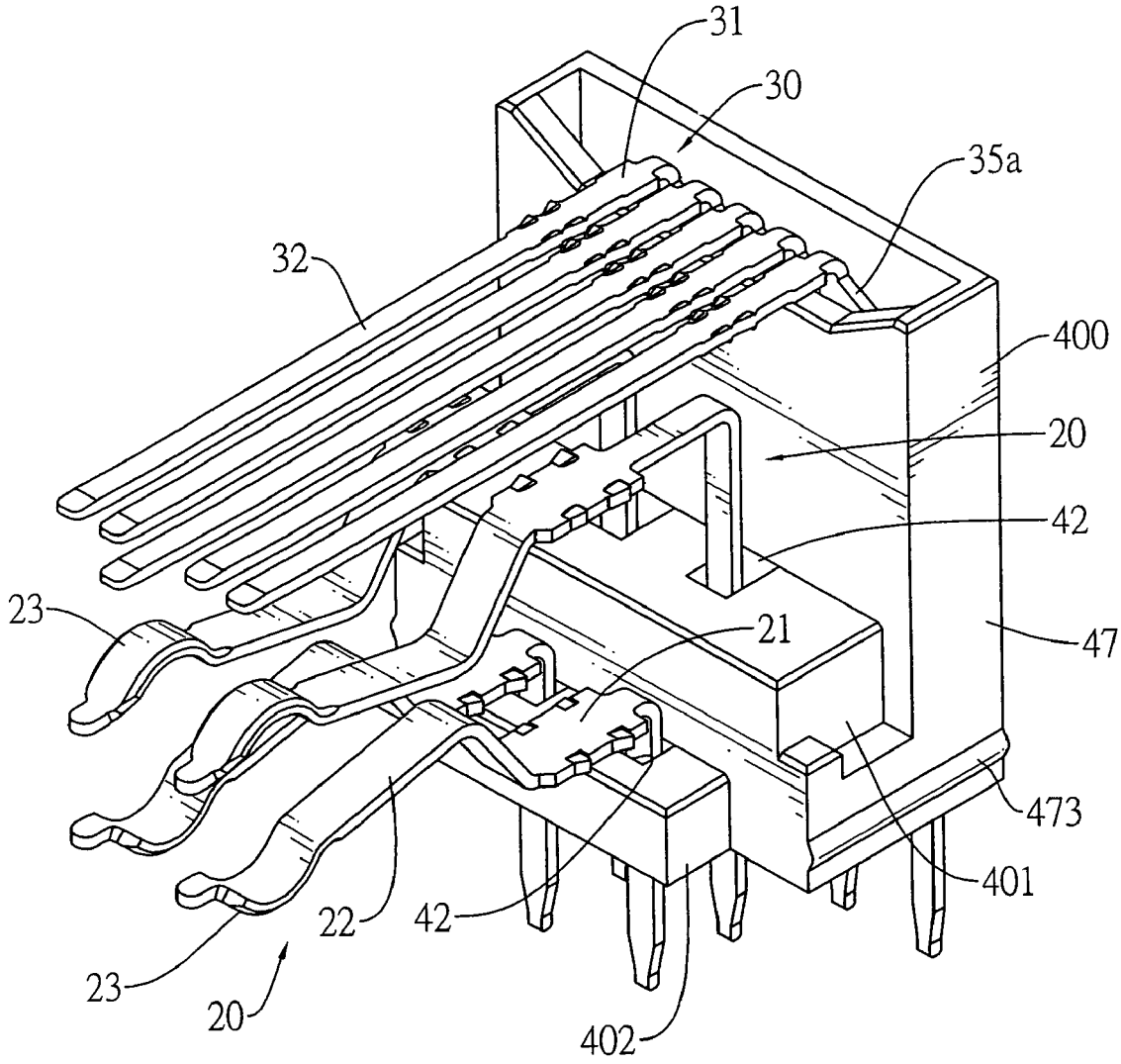
FIG. 7 is a perspective view of the first terminals, second terminals and terminal shield of the electrical connector in FIG. 3.
Figure 8:
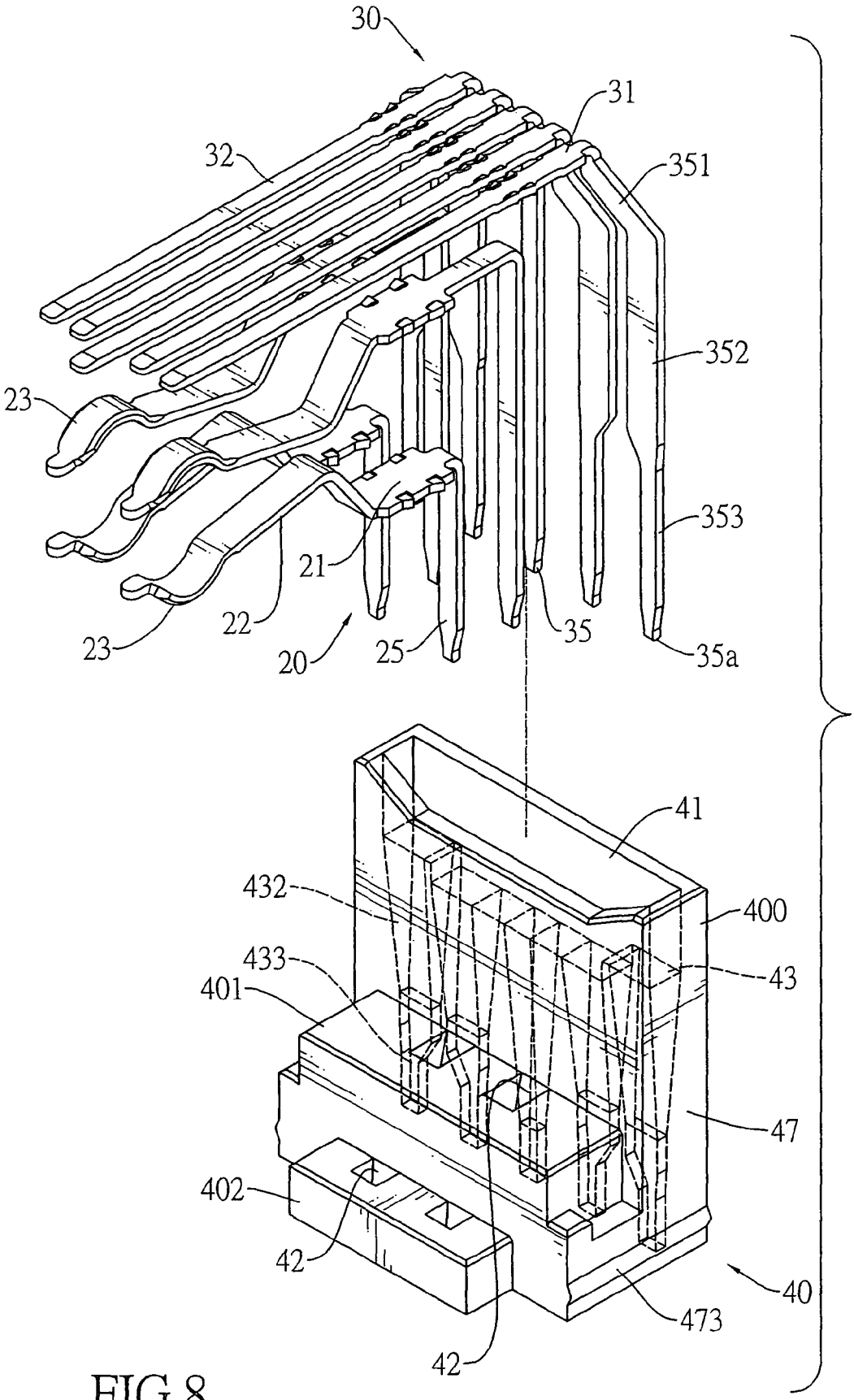
FIG. 8 is an exploded perspective view of the first terminals, second terminals and terminal shield of the electrical connector in FIG. 7.
Figure 9:
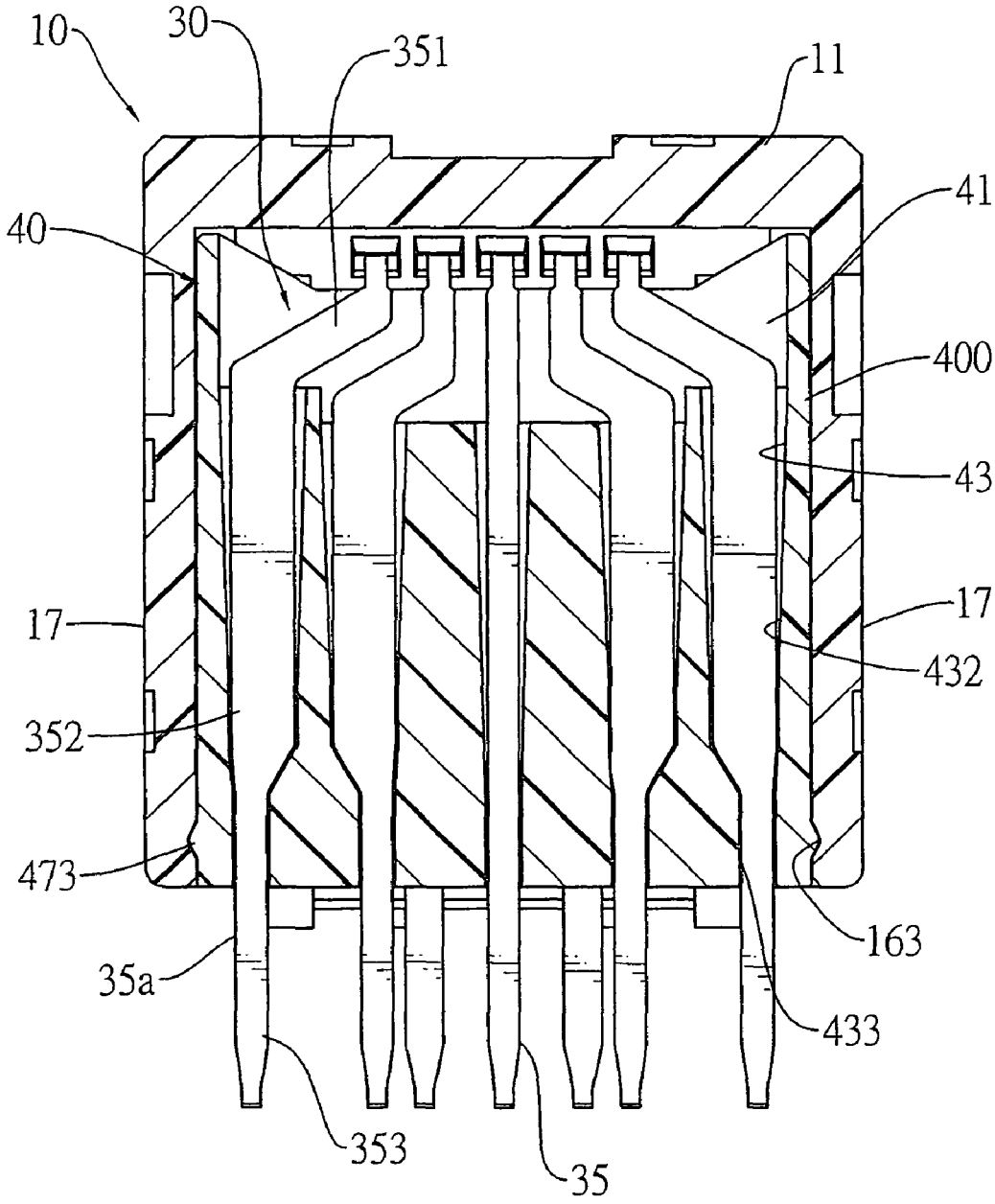
FIG. 9 is a rear view in partial section of the electrical connector in FIG. 5 without the metal shell assembly.
Figure 10:
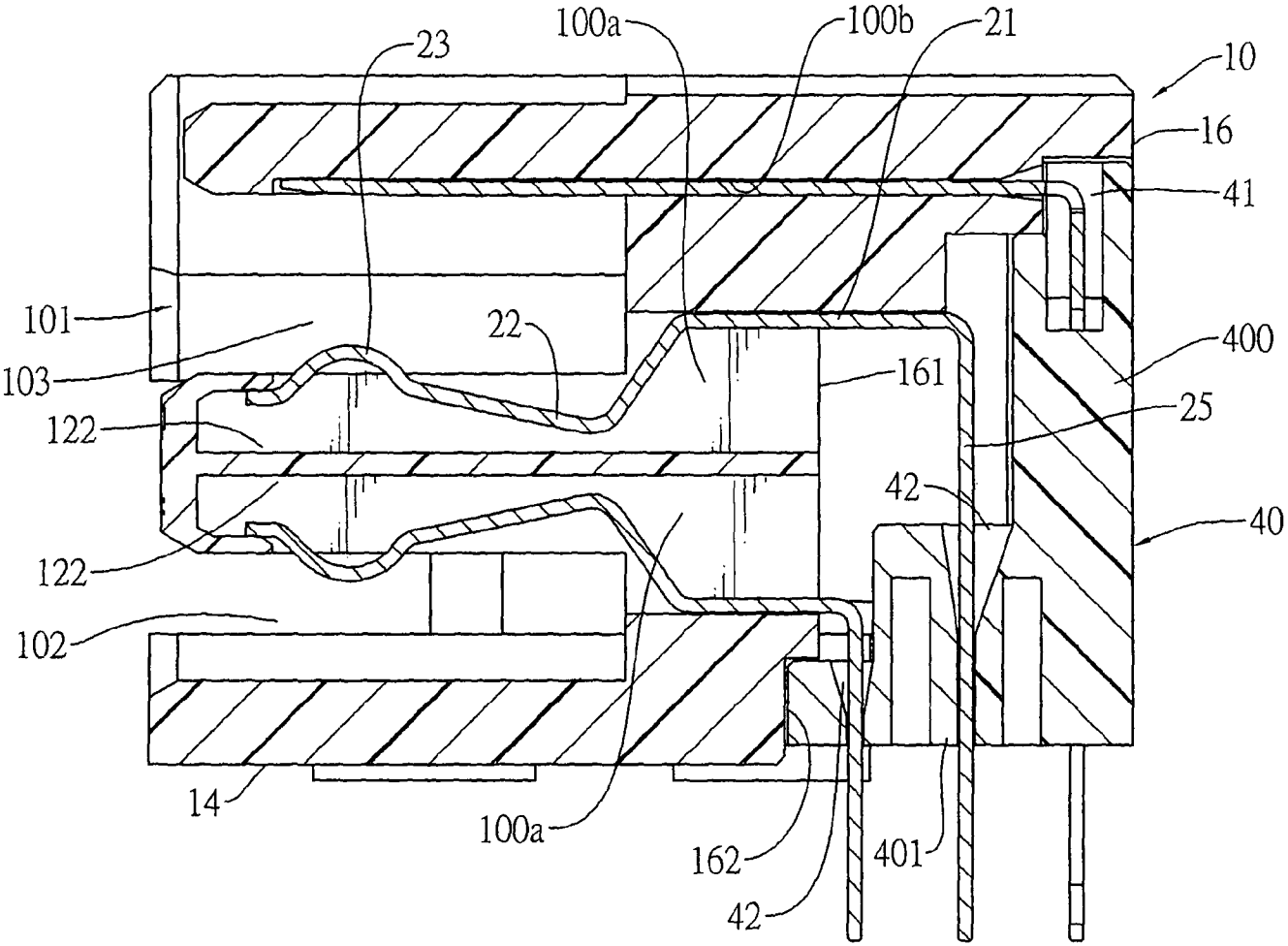
FIG. 10 is a cross sectional side view of the electrical connector in FIG. 5 without the metal shell assembly.
Figure 11:
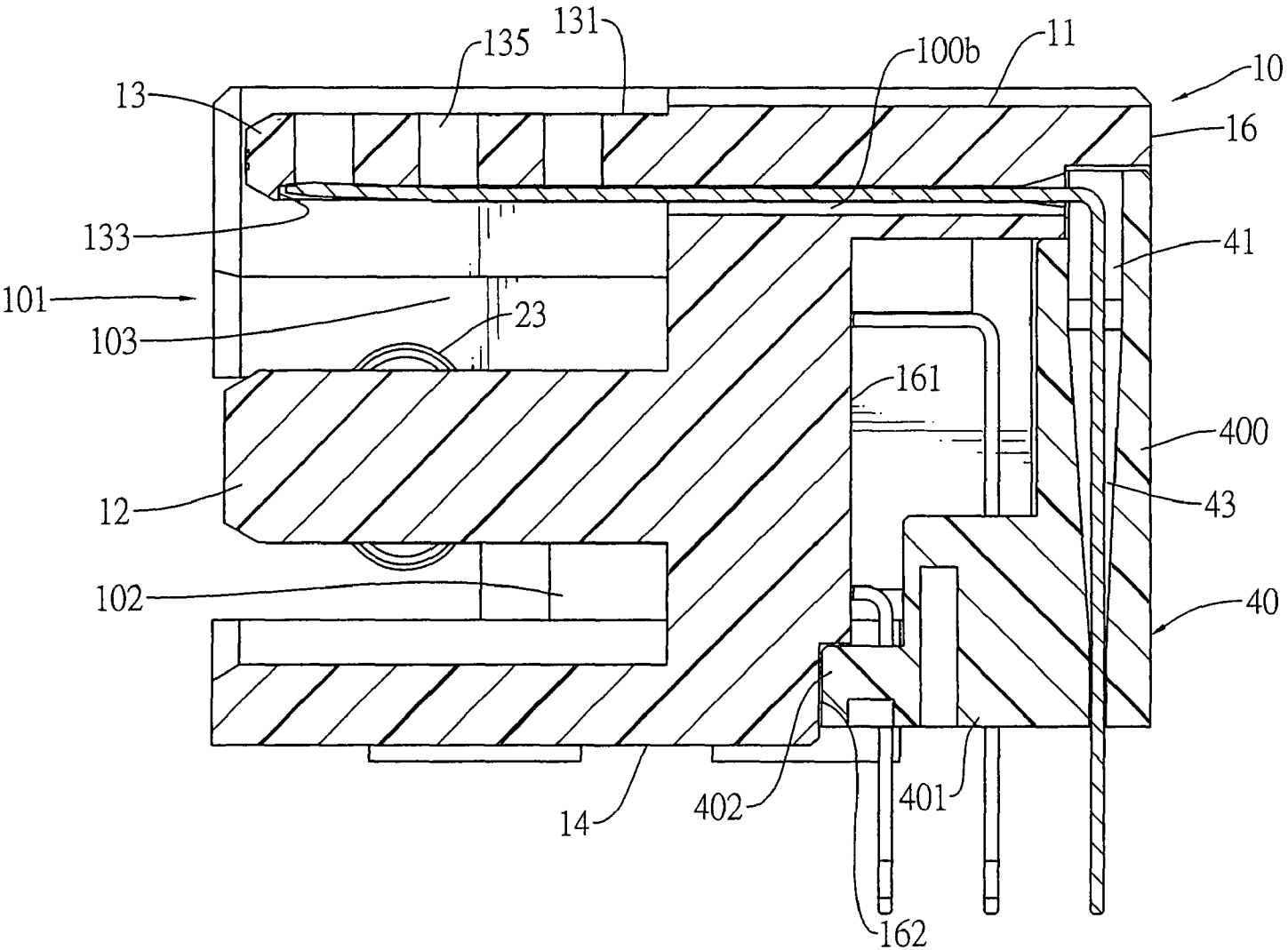
FIG. 11 is another cross sectional side view of the electrical connector in FIG. 5 without the metal shell assembly.

With reference to FIGS. 1 to 4, an electrical connector in accordance with the present invention may be a receptacle connector complying with USB (Universal Serial Bus) 2.0 and 3.0 transmission protocols and mounted on a PCB (printed circuit board) (P).

The electrical connector comprises an insulative housing (10), a plurality of first terminals (20), a plurality of second terminals (30), a terminal shield (40) and a metal shell assembly.

With further reference to FIGS. 5, 6, 10 and 11, the insulative housing (10) has a top (11), a bottom (14), a front (15), a rear (16), two opposite sides (17), a cavity (101), a first tongue (12), a second tongue (13) and an opening (161) and may further have a plurality of first terminal holes (100*a*), a plurality of second terminal holes (100*b*), an alignment recess (162) and two mounting recesses (163).

The cavity (101) is defined in the front (15) and has an inner surface.

The first tongue (12) is formed on and protrudes forwards from the inner surface of the cavity (101), may extend into an opening in a corresponding USB 2.0 plug connector, may divide the cavity (101) into a first space (102) and a second space (103) and may have a top surface, a bottom surface and two sets of first terminal slots (122). The first space (102) is under the first tongue (12) and may hold a corresponding USB 2.0 plug connector. The second space (103) is above the first tongue (12) and may hold a corresponding USB 2.0 or 3.0 plug connector. The sets of the first terminal slots (122), may be two pairs, are respectively defined in the top and bottom surfaces.

The second tongue (13) is formed on the top (11) above the first tongue and may have a top surface (131), a bottom surface, a plurality of second terminal slots (133) and rows of ventilation holes (135). The top surface (131) of the second tongue (13) may be lower than the top (11) of the insulative housing (10). The second terminal slots (133) are defined in the bottom surface of the second tongue (13) and may be five. The rows of the ventilation holes (135) are defined in the top surface (131) of the second tongue (13), communicate respectively with the second terminal slots (133) and may be distributed longitudinally along the second tongue (13). The top surface (131) lower than the top (11) of the insulative housing (10) facilitates air flowing into the ventilation holes (135) and contacting terminals in the second terminal slots (133) to stabilize the impedance of the terminals and improve signal transmission efficiency.

The opening (161) is defined in the bottom (14) and the rear (16) and has an inner surface.

The first terminal holes (100*a*) are defined in the insulative housing (10).

The second terminal holes (100*b*) are defined in the insulative housing (10).

The alignment recess (162) are defined in the inner surface of the opening (161).

The mounting recesses (163) are defined in the inner surface of the opening (161) and correspond respectively to the sides (17).

The first terminals (20) may be four, may comply with the USB 2.0 transmission protocol, are mounted in the insulative housing (10), are mounted on the first tongue (12) and may be mounted respectively through and correspond respectively to the first terminal holes (100*a*) and be mounted respectively in and correspond respectively to the first terminal slots (122). Each first terminal (20) has a mounting section (21), a resilient section (22), a contacting section (23) and a soldering section (25).

The mounting section (21) is mounted in a corresponding first terminal hole (100*a*).

The resilient section (22) is formed on and protrudes forwards from the mounting section (21) and is mounted in a corresponding first terminal slot (122).

The contacting section (23) may be curved, is formed on and protrudes from forwards the resilient section (22) and is mounted in and extends upwards from the corresponding first terminal slot (122).

The soldering section (25) is formed on and protrudes perpendicularly downwards from the mounting section (21) and may be soldered on the PCB (P).

The second terminals (30) may be five, may comply with the USB 3.0 transmission protocol to transmit high frequency signals, are mounted in the insulative housing (10), are mounted on the second tongue (13) and may be mounted respectively through and correspond respectively to the second terminal holes (100*b*) and be mounted respectively in and correspond respectively to the second terminal slots (133). Each second terminal (30) has a mounting segment (31), a contacting segment (32) and a soldering segment (35, 35*a*).

The mounting segment (31) is mounted in a corresponding second terminal hole (100*b*) of the insulative housing (10).

The contacting segment (32) is formed on and protrudes forwards from the mounting segment (31), is mounted a corresponding second terminal slot (133), communicates with one row of the ventilation holes (133) so that airflow from the ambient environment may contact the contacting segment (32) to improve the stability of the impedance of the contacting segment when the electrical connector operates.

The soldering segment (35, 35*a*) is formed on and protrudes downwards from the mounting segment (321) and may be soldered on the PCB (P). Furthermore, each soldering segment (35*a*) except the soldering segment (35) of a central one of the second terminals (30) has an inclined portion (351), a wide portion (352) and a narrow portion (353). The inclined portion (351) obliquely protrudes downwards from the mounting segment (231) and away from the central second terminal (30). The wide portion (352) protrudes downwards from the inclined portion (351). The narrow portion (353) is thinner than and protrudes downwards from the wide portion (352). The inclined portions (351) are arranged as a sector to enlarge intervals between adjacent narrow portions (353) to facilitate the process soldering the narrow portions (353) to the PCB (P) and prevent the shorting problem due to solder contacting two or more narrow portions (353).

With further reference to FIGS. 7 to 10, the terminal shield (40) is substantially L-shaped, is mounted in the opening (161) of the insulative housing (10) and has two opposite sides (47), a base (400), a first positioning bracket (401) and a second positioning bracket (402).

Each side (47) may have a mounting rib (473) formed on the side (47) and mounted in one mounting recess (163) of the insulative housing (10).

The base (400) is upright, substantially completely shields the soldering segments (35, 35*a*) of the second terminals (30) except parts of the solder segments (35, 35*a*) through and under the PCB (P) and has an open top (41) and a plurality of channels (43). The channels (43) may be five, are uprightly defined through the base (400), communicate with the open top (41) and respectively hold the soldering segments (35, 35*a*) of the second terminals (30). Each channel (43) except a central one of the channels (43) may have a wide area and a narrow area respectively holding the wide and narrow portions (352, 353) of the soldering segment (35*a*) of one second terminal (30) to prevent the soldering segment (35*a*) from inadvertently sliding. The base (400) substantially completely shielding the solder segments (35, 35*a*) of the second terminals (30) prevents the soldering segment (35, 35*a*) from exposure under air and electromagnetic interference with other electrical components so that the impedance of the operating second terminals (30) are stables to advantage the high frequency signal transmission.

The first positioning bracket (401) is formed on and protrudes forwards from the base (400) and has a plurality of passageways (42). The passageways (42) are defined uprightly through the first positioning bracket (401) and respectively hold the solder sections (25) of some of the first terminals (20).

The second positioning bracket (402) is formed on and protrudes forwards from the first positioning bracket (401) and has a plurality of passageways (42). The passageways (42) are defined uprightly through the second positioning bracket (402) and respectively hold the soldering sections (25) of remains of the first terminals (20).

The metal shell assembly covers the insulative housing (10) and may have a front casing (50) and a rear casing (60).

The front casing (50) covers the insulative housing (10) adjacent to the front (15) and has a front opening, a top plate, two opposite side plates (57), two pressing tabs (51) and two buckling tabs (571). The pressing tabs (51) are formed on and protrude respectively from the side plates (57) inwards into the first space (102) of the insulative housing (10) and may tightly press the corresponding USB 3.0 plug connector. The buckling tabs (571) are formed respectively on the side plates (57).

The rear casing (60) covers the insulative housing (10) adjacent to the rear (16) and has a top plate, two side plates (67) and two buckling loops (671). The buckling loops (671) are formed respectively on the side plates (67) and are engaged respectively with the buckling tabs (571) of the front casing (50).

Figure 12:
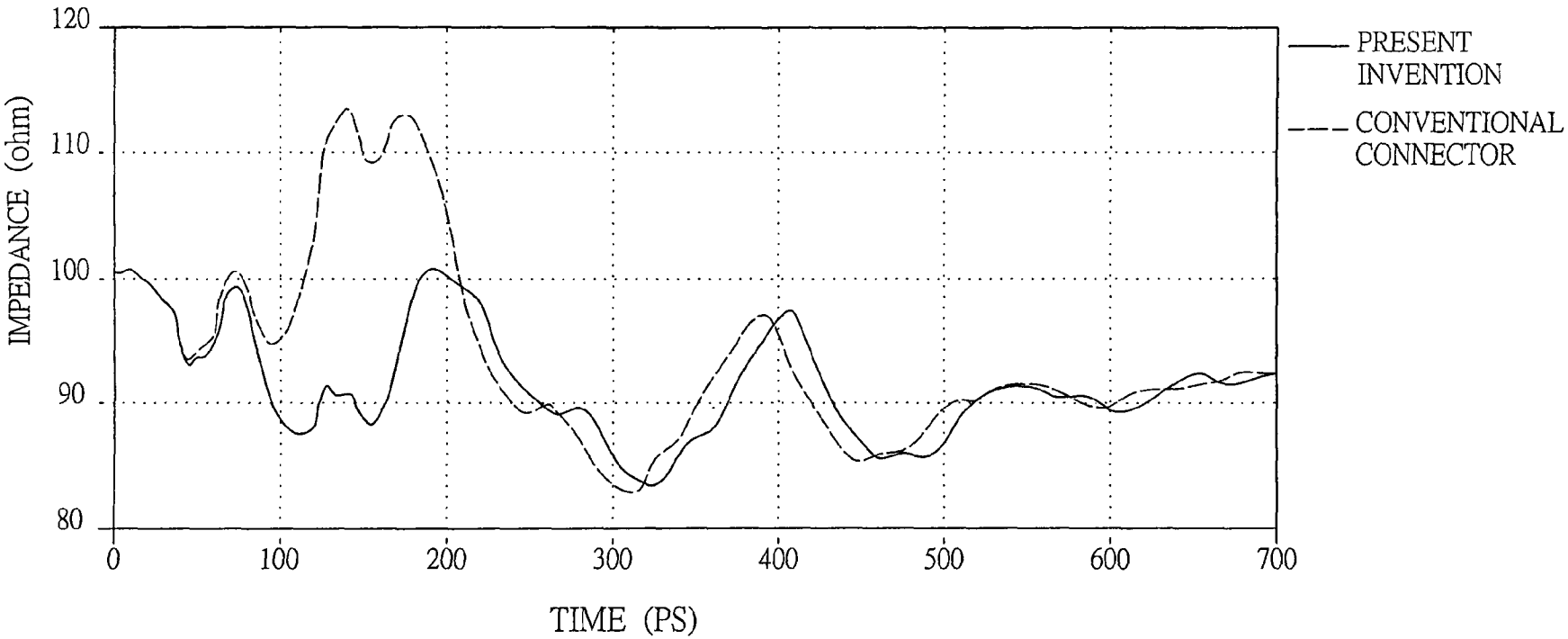
FIG. 12 is an impedance-time curve diagram showing curves of the electrical connector in FIG. 1 and a conventional connector during the signal transmission.

With further reference to FIG. 12 being an impedance-time diagram showing two curves respectively indicating the electrical connector of the present invention and a conventional connector. The unit of the impedance is "ohm" and that of the time is "$10^{-12}$ second (Pico-second, PS)". The conventional connector has a shorter shield not completely shielding the soldering segments of the second terminals when compared to the present invention. As indicated by the curves, when signal transmission is implemented, the impedance of the conventional connector vibrates up and down more violently than that of the electrical connector of the present invention. Therefore, the electrical connector with the base (400) of the terminal shield (40) completely shielding the second segments (35, 35*a*) of the second terminals (30) improves the stability of the impedance and advantages the high frequency signal transmission on the second terminals (30). Even the electrical connector of the present invention is connected to other manufacturers' USB 3.0 plug connectors, the impedance mating therebetween is better than that between conventional connectors.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a top, a bottom, a front and a rear and further having a cavity defined in the front and having an inner surface;

a first tongue formed on and protruding forwards from the inner surface of the cavity;

a second tongue of the insulative housing having a top surface with ventilation holes therein and formed on the top above the first tongue; and an opening defined in the bottom and the rear and having an inner surface;

a plurality of first terminals mounted in the insulative housing and mounted in the first tongue and each first terminal having a mounting section, a resilient section, a contacting section and a soldering section being mounted in a printed circuit board;

a plurality of second terminals mounted in the insulative housing, mounted in the second tongue and each second terminal having a mounting segment, a contacting segment and a soldering segment being mounted in the printed circuit board;

a terminal shield being mounted in the opening of the insulative housing and having two opposite sides;

a base being upright, completely shielding the soldering segments of the second terminals and having an open top and a plurality of channels uprightly defined through the base, communicating with the open top and respectively holding the soldering segments of the second terminals;

a first positioning bracket formed on and protruding forwards from the base and having a plurality of passageways defined uprightly through the first positioning bracket and respectively holding the solder sections of some of the first terminals; and a second positioning bracket formed on and protruding forwards from the first positioning bracket and having a plurality of passageways defined uprightly through the second positioning bracket and respectively holding the soldering sections of remains of the first terminals; and a metal shell assembly covering the front and the rear of the insulative housing and being mounted on the printed circuit board.

2. The electrical connector as claimed in claim 1, wherein each soldering segment except the soldering segment of a central one of the second terminals has an inclined portion obliquely protruding downwards from the mounting segment and away from the central second terminal;

a wide portion protruding downwards from the inclined portion; and a narrow portion being thinner than and protruding downwards from the wide portion.

3. The electrical connector as claimed in claim 2, wherein each channel of the base of the terminal shield except a central one of the channels has a wide area and a narrow area respectively holding the wide and narrow portions of the soldering segment of one second terminal.

4. The electrical connector as claimed in claim 3, wherein the insulative housing further has a plurality of first terminal holes and second terminal holes defined in the insulative housing;

the first tongue divides the cavity into a first space and a second space and has a top surface, a bottom surface and two sets of first terminal slots respectively defined in the top and bottom surfaces;

the second tongue has a top surface, a bottom surface and a plurality of second terminal slots defined in the bottom surface of the second tongue;

the first terminals are mounted respectively through and correspond respectively to the first terminal holes and are mounted respectively in and correspond respectively to the first terminal slots; and the second terminals are mounted respectively through and correspond respectively to the second terminal holes and are mounted respectively in and correspond respectively to the second terminal slots.

5. The electrical connector as claimed in claim 4, wherein in each first terminal, the mounting section is mounted in a corresponding first terminal hole, the resilient section is formed on and protrudes from the mounting section and is mounted in a corresponding first terminal slot, the contacting section is formed on and protrudes from the resilient section and the soldering section is formed on and protrudes downwards from the mounting section.

6. The electrical connector as claimed in claim 5, wherein in each second terminal, the mounting segment is mounted in a corresponding second terminal hole, the contacting segment is formed on and protrudes from the mounting segment and is mounted in a corresponding second terminal slot and the soldering segment is formed on and protrudes downwards from the mounting segment.

7. The electrical connector as claimed in claim 6, wherein the first terminals comply with the USB 2.0 transmission protocol.

8. The electrical connector as claimed in claim 7, wherein the second terminals comply with the USB 3.0 transmission protocol.

9. The electrical connector as claimed in claim 8, wherein the metal shell assembly has a front casing covering the insulative housing adjacent to the front and having a front opening, a top plate and two opposite side plates and further having two pressing tabs formed respectively on the side plates inwards into the first space; and two buckling tabs formed respectively on the side plates; and a rear casing covering the insulative housing adjacent to the rear and having a top plate, two side plates and two buckling loops formed respectively on the side plates and engaged respectively with the buckling tabs.

* * * * *